US005266369A

United States Patent [19]

Ando et al.

[11] Patent Number: 5,266,369

[45] Date of Patent: Nov. 30, 1993

[54] PACKAGING MATERIAL MADE OF ELECTRET MATERIAL AND PACKAGING METHOD

[75] Inventors: Katsutoshi Ando; Katsuya Ogawa; Eiichi Nishiura; Yoshiharu Okumura; Yoshikazu Ii, all of Otsu, Japan

[73] Assignee: Toray Industries, Inc., Tokyo, Japan

[21] Appl. No.: 939,972

[22] Filed: Sep. 4, 1992

Related U.S. Application Data

[63] Continuation of Ser. No. 490,595, filed as PCT/TP88/00955, on Sep. 21, 1988, abandoned.

[51] Int. Cl.[5] ..... B32B 33/00

[52] U.S. Cl. ..... 428/35.7; 428/409; 428/36.92; 206/484; 206/564; 206/521.1; 426/107; 426/234

[58] Field of Search ..... 428/409, 34.8, 35.2, 428/35.5, 35.7, 36.4, 36.92; 426/106, 107, 127, 129, 234; 206/484, 564, 521.1

[56] References Cited

U.S. PATENT DOCUMENTS

| | | | |
|---|---|---|---|
| Re. 31,285 | 6/1983 | Van Turnhout et al. | 428/369 |
| 3,998,916 | 12/1976 | Van Turnhout | 264/22 |
| 4,623,438 | 11/1986 | Felton et al. | 428/397 |
| 4,874,659 | 10/1989 | Ando et al. | 428/221 |
| 4,879,430 | 11/1989 | Hoffman | 428/35.1 |
| 4,888,223 | 12/1989 | Sugimoto et al. | 428/35.4 |

*Primary Examiner*—A. A. Turner

*Attorney, Agent, or Firm*—Nikaido, Marmelstein, Murray & Oram

[57] ABSTRACT

A packaging material according to the present invention includes an electret material having a surface part mutually different polarized electric charges on a front surface and a rear surface thereof. A method of packaging according to the present invention includes covering at least a portion of an object using the packaging material.

3 Claims, 2 Drawing Sheets

PACKAGING MATERIAL MADE OF ELECTRET MATERIAL AND PACKAGING METHOD

This application is a continuation of application Ser. No. 07/490,595 filed as PCT/JP88/00955, on Sep. 21, 1988, now abandoned.

TECHNICAL FIELD

The present invention relates to a packaging material and a packaging method and, more particularly, those for packaging an object so that its original freshness can be maintained intact for a long period of time.

BACKGROUND ART

To maintain the freshness of fresh vegetables, fruits and so forth, conventionally it has been of practice at supermarkets and grocery stores (grocer's shops) to package such fresh foodstuffs with resin films of such as a polyvinylidene chloride resin, a polyethylene resin and so forth. By this packaging with a resin film, a certain degree of advantageous results has been attained. For example, the evaporation of moisture of the merchandise can be suppressed and, at the same time, the merchandise can be prevented from becoming polluted with environmental pollutants which can lower their commercial value.

However, the packaging with a resin film is not effective beyond suppress the evaporation of moisture and that prevention of pollution. It is not effective in inhibiting reproductive cells of germs and/or molds which tend to propagate in packaged objects. By relying on this packaging, it is impossible to prevent the growth of, for example mold in packaged objects when they are left standing for more than a week after packaging. Also, while fresh foodstuffs such as fresh vegetables and fruits tend to grow dull in color or undergo a color change as time lapses, it has been impossible to effectively prevent such loss of or change in color by packaging with conventional resin films.

Thus, by relying on packaging with conventional resin films, there has been a limitation in maintaining the original freshness for an extended period of time and/or in preventing the growth of molds.

DISCLOSURE OF THE INVENTION

An object of the present invention is to overcome the above point-out shortcomings and limitations involved in conventional packaging materials and packaging methods, and to provide a packaging material and a packaging method which can maintain the original freshness for a prolonged period of time.

Another object of the invention is to provide a packaging material and a packaging method by which it is possible to maintain for a long period of time the original freshness of a variety of objects including not only fresh foodstuffs such as fresh vegetables and fruits but also sampled animal and plant specimens. The object of the invention is also not to permit packaged objects to get dull in color or undergo a color change and to inhibit propagation of reproductive cells of germs and molds.

The packaging material to attain the above objects according to the present invention is characterized by comprising an electret material including a surface portion having mutually and oppositely polarized electric charges in its front surface and its back surface.

The packaging method according to the present invention is characterized by surrounding at least a part of an object to be packaged with the above packaging material.

A packaging material having a surface portion of which the front surface and the rear or back surface have differently polarized charges as above can produce an electric field around itself. The electric field exerts an electrical stimulation on an object or a product packaged with the material, whereby it is possible to maintain the original fresness of the packaged product and to inhibit the propagation of germs, molds and so forth in the packaged product.

DETAILED DESCRIPTION OF THE PREFERRED EMBODIMENT

Figure 1:
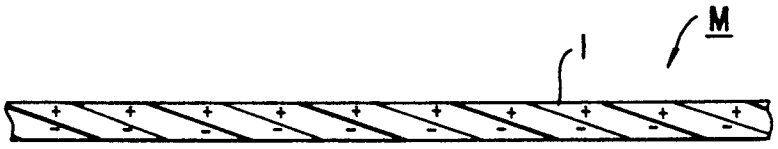
FIG. 1 is a longitudinal sectional view, showing a portion of the packaging material having a resin film according to an embodiment of the present invention.

The electret material useful for the packaging material according to the present invention is required to include a surface portion having a front or top surface and a back or bottom surface which are imparted with mutually oppositely polarized electric charges.

In order for the electret material to have the above surface portion, the electret material may be any of the forms of sheet-type products having a flexibility such as films, non-woven fabrics, papers and knit or woven fabrics, and molded structural bodies or shaped resin moldates having rigidity in any of the forms such as a box, a cup, a dish and a bottle. That is to say, the surface portion may include any of a flat surface, a curved surface and a cubic surface. Particularly, sheet-type films are most advantageously useful, and normally they are processed to a bag-type product, into which an object to be packaged may be placed to possibly provide a sealed package.

Now that the electret material for use in or for the present invention is required to include a surface portion of which the front surface and the rear surface can be electrified respectively with a positively polarized charge and a negatively polarized charge, the material for the electret material should preferably have an electric resistivity of at least $10^{13}\Omega$.cm. For such a material, resins are preferably useful, such as polyolefin resins, polyester resins, fluorine-containing resins, polyvinyl chlorides, polyamide resins and polyacrylic resins. Specifically, polyolefin resins such as polypropylene and polyethylene are preferably used, and among all, polypropylene would be the optimal material.

It is recommendable to incorporate into the above resin an effective additive for enhancing the surface charge density. For preferable additives, there may be named such materials as hindered phenol, hindered amine, an antioxidant such as a sulfur-based one, and metal salts of polar polymer fatty acids.

It is also advantageous to knead into the above resin a powder of inorganic substances such as Oya-ishi (a kind of tuff) and porous ceramics as an effective additive for absorbing ethylene gas and preserving the freshness.

For purposes of the present invention, the method for electrifying a resin material formed with a surface portion as described above, namely the method for electrifying the respective surfaces of the surface portion with polarized charges, is not particularly limited, and for this, any of the known methods for placing the surface portion of the resin material between a discharging electrode with a grounding electrode and a high voltage being impressed between the electrodes are applicable. For example, the electrification processes proposed by the inventors of the present invention in patent application Kokai publications No. 61-282471 and No. 61-289177 are useful as particularly preferable method.

The amount of the electric charge to be imparted to the surface portion according to the present invention is preferably to be such as to attain a surface charge density per surface of at least $1\times10^{-11}$ coulomb/cm$^2$ or, more preferably, at least $1\times10^{-10}$ coulomb/cm$^2$, or even more preferably, at least $1\times10^{-9}$ coulomb/cm$^2$. When an electrification is made to provide a surface charge density as above, it is possible to let an electric field be generated around the electret material and realize an effective function for maintaining the freshness of a packaged product.

Figure 6:
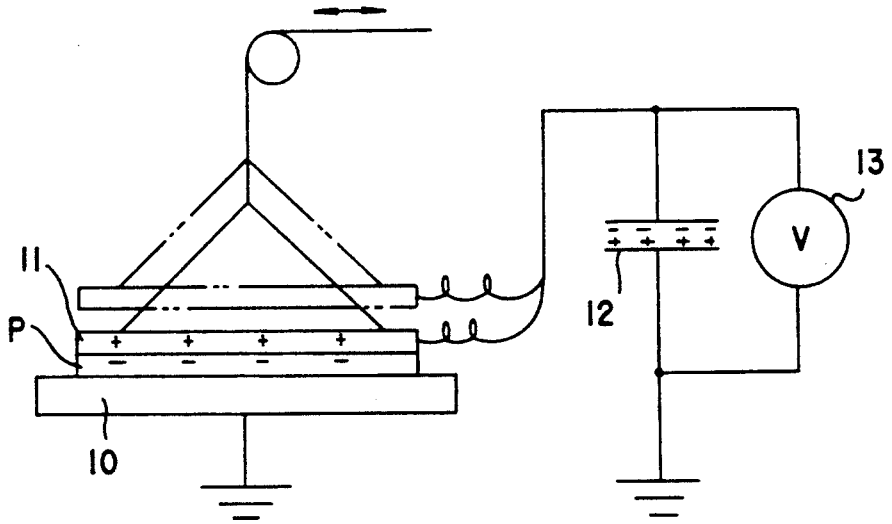
FIG. 6 shows a type view of a measurement arrangement for finding the surface charge density of electret materials.

The above termed surface charge density is found by using a measurement system or arrangement as shown in FIG. 6 and described as follows. In FIG. 6, the reference numeral 10 denotes a grounded metal electrode made of brass, and the numeral 11 denotes a metal electrode also made of brass and having an area size of 100 cm$^2$, the latter metal electrode 11 being adapted to be movable up and down relative to the other metal electrode 10. A sample P (having an area size of 100 cm$^2$) of an electret material is placed between the metal electrodes 10 and 11, and the electric charge to be generated due to the electrostatic induction when the electrode 11 is upwardly moved from its closed position shown by solid lines to the open position shown by broken lines is measured in terms of a voltage V by a voltmeter 13 (a high performance electrometer, TR8562, a product of Takeda Riken K. K.) through a capacitor 12.

From the voltage V found as above, the surface charge density of the electret sample P is calculated according to the following calculation equation:

$$\text{surface charge density (coulomb/cm}^2) = C\times V/S,$$

providing:

C=capacitance of the capacitor (farad);

V=voltage (volt); and

S=area size of the sample (cm$^2$)

In an electret material made with use of a resin added with the above described additive so as to enhance the surface charge density and imparted with electric charges by the electrification process, the electric charges are polarized at a high degree of polarization orientation in a front surface region and a rear surface region in the electret material, which therefore are heteropolar. That is to say, if the front or top surface region bears a negative charge, then the rear or bottom surface region bears a positive charge. The electric charges in the electret material being dipolar polarized to the front and the rear surface regions as above, an electric field is formed around the electret material, and the electret material can exhibit its function as electret stable for a long period of time. In connection with the condition of polarization of electric charges, it is not always necessary that electric charges of a same polarity are distributed over a whole of a same surface region, and it may alternatively be made that surface portions having opposite polarities are present in part in the whole of a same surface region.

According to the present invention, the above described electret material is made a sheet-type product or a shaped resin moldate to provide various packaging materials. Among the various possible packaging materials, resin films come are the optimal packaging material in that they are so flexible or pliable that they can easily take to the shape of objects to be packaged, they are easy to handle and, in addition, they are sealable.

In using a resin-film packaging material for packaging fresh foodstuffs which actively respire such as fresh vegetables and fruits, preferably the packaging material should be made to effect a completely sealed packaging. This is because if the packaging with the resin film is in an opened condition, the degree of the freshness of the packaged object tends to considerably lower as a result of transpiration accompanying the respiration of the packaged object. This gives rise to withering, decaying, drying and so forth of the object. However, if a completely sealed packaging is effected as above, this is likely to accompany the phenomenon that as a result of respiration of the packaged object, the concentration of carbon dioxide gas inside the packing tends to rise abnormally, while the concentration of oxygen inside the pack is lowered. That is to say, a problem likely to occur is that the packaged fresh product can no longer have normal respiration and that the transpired moisture becomes condensed to form dew thereby permit the propagation of microorganisms.

Thus, the resin film in use for the packaging material for fresh products such as fresh vegetables and fruits should preferably have an appropriate degree of selective permeability carbonic acid gas and oxygen. Whereas this gas permeability may vary depending on the kind or nature of products to be packaged, for fresh products such as fresh vegetables and fruits, the permeability of carbonic acid gas is preferably within a range of 500 to 350,000 cc/m$^2$.24 hr.atm or, more preferably, 25,000 to 250,000 cc/m$^2$.24 hr.atm, while the oxygen permeability is preferably within a range of 100 to 35,000 cc/m$^2$.24 hr.atm or, more preferably, 3,000 to 30,000 cc/m$^2$.24 hr.atm.

Also, to prevent moisture transpired from a packaged fresh product from becoming condensed to form dew on the inner surface of the packaging material, the resin film should necessarily have suitable moisture permeability. While this moisture permeability, too, may vary depending on the kind or nature of a product to be packaged, for products such as fresh vegetables and fruits, the moisture permeability is preferably within a range of 5 to 700 g/m$^2$.24 hr or, more preferably, 20 to 500 g/m$^2$.24 hr. If this moisture permeability is lower than 5 g/m$^2$.24 hr, then a loss of or a change in color of the packaged product is likely. If the moisture permeability is higher than 700 g/m$^2$.24 hr, withering, decaying and drying of the packaged product are likely, resulting in a considerable lowering of the freshness of the product.

Further, in packaging a product which undergoes a particularly large extent of transpiration of moisture among various fresh products, it is recommendable to use a packaging material appropriately formed with a number of openings so that formation of dew from the transpired moisture from such fresh products can be prevented.

Where an object to be packaged is meat such as butcher's meat, the oxygen permeability of the packaging material should preferably be lower than the above recited preferred range for fresh products. That is to say, the oxygen permeability that the packaging material resin film should have in the present case is preferably within a range of 5 to 200 cc/m$^2$.24 hr.atm or, more preferably, 20 to 100 cc/m$^2$.24 hr.atm. If this oxygen permeability is lower than 5 cc/m$^2$.24 hr.atm, the packaged product tends to undergo a dulling or change in color, while if it exceeds 200 cc/m$^2$.24 hr.atm, then the product is liable to oxidize and permit the propagation of microorganisms.

Further, the above recited permeability of carbonic acid gas, oxygen permeability and moisture permeability are according to the following prescriptions in JIS standards.

carbonic acid gas permeability: JIS Z 1707 method (20° C., 90% RH);

oxygen permeability: JIS Z 1707 method (20° C., 90% RH); and moisture permeability: JIS Z 0208 method (40° C., 90% HR).

Ultraviolet rays promote the change in color in and oxidation of meat such as butcher's meat. Resin films for use for the packaging of such a product should advisably be colored in reddish orange or be printed as such thereon so as to shut out ultraviolet rays. Alternatively, the packaging could be made of a composite body comprising a resin film and another sheet or film colored in reddish orange.

In the case of packaging material comprising a resin film, its thickness should preferably be on the order of 4 to 300 μm or, more preferably, 6 to 100 μm or, particularly preferably, 10 to 50 μm so that this material can be applied to closely attach on an object to be packaged. If this thickness is less than 4 μm, the packaging material is prone to undergo tearing or ripping, while if it is greater than 300 μm, the packaging material tends to have such a low flexibility or pliability that it cannot provide any desirable packing adaptability.

FIG. 1 shows an example of packaging materials M according to the present invention, which comprises a sheet-type resin film 1. This resin film 1 is electrified and has polarized electric charges in a front or top surface region and in a rear or bottom surface region such that while the front surface region bears positive charges, the rear surface region bears negative charges. In packaging a product with this packaging material M comprising the resin film 1, it may be operated to either enrobe the product directly with the material M, or first process the material M to a bag-type device and then place the product into this bag-type device.

Figure 2:
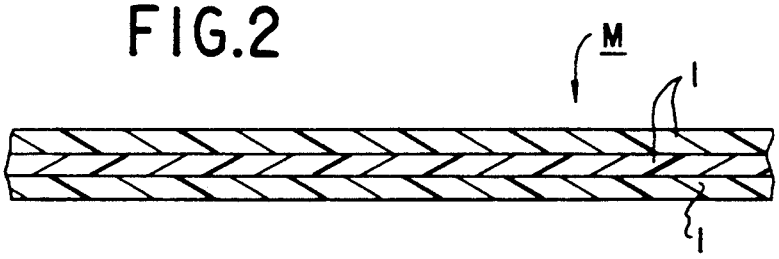
FIG. 2 is a longitudinal sectional view, showing a portion of a packaging material having a laminate of resin films according to another embodiment of the invention.

Also, the packaging may be made with use of a single ply of the resin film 1. Alternatively to this, the packaging may be made to laminate a plurality of the film 1 altogether as shown in FIG. 2 to form a laminate packaging material and carry out the packaging with the laminate material. In providing a packaging material comprising a laminate structure as above, while adjacent films in the laminate structure have a polar orientation of polarized charges, the surface region bearing positive charges and the surface region bearing negative charges of a first film faces the corresponding respective surface regions of a second film. According to this lamination arrangement, it is possible to intensify the polarity of an outermost surface region to accordingly increase the intensity of an electric field being then formed, whereby it is possible to further prolong the preserved life of a packaged product. Also, it is possible to enhance or improve various characteristics of the packaging material relative to the environmental conditions such as durability, chemical resistance, heat resistance and cold resistance.

In order not to impair the electret characteristics in laminating a plurality of the resin film altogether, bonding the films to be mutually laminated using an adhesive agent or by a mechanical bonding would be recommended. Alternatively, the lamination of films together may be carried out by an embossing process or by ultrasonic welding, providing that the number of films to be laminated together should be appropriately limited so as not to impair the required permeability of carbonic acid gas, the oxygen gas permeability and the moisture permeability.

Figure 3:
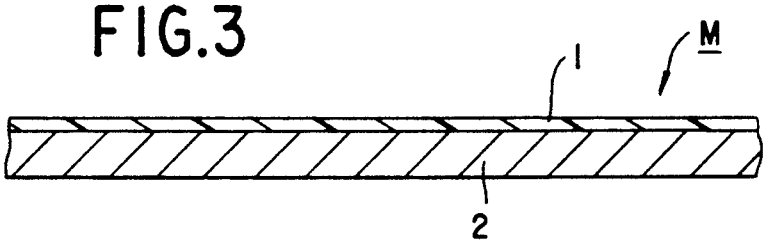
FIG. 3 is a longitudinal sectional view, showing a portion of a packaging material incorporating a composite material composed of a resin film and a sheet-type carrier material, according to a still another embodiment of the present invention.

Also, as shown in FIG. 3, a packaging material comprising a resin film may be made into a composite material by combining the resin film 1 of an electret material, with another sheet-type product 2 such as a non-woven fabric, a woven or knit fabric or a paper. The sheet-type product 2 for use for the making of a composite material may be either electrified or not, preparatively. In this connection, it is provided that the sheet-type product 2 for use here should not be one detrimental to the electrical activity of the resin film 1 comprising an electret material and also that the range of the thickness of the sheet-type product 2 should be carefully selected for use.

Figure 4:
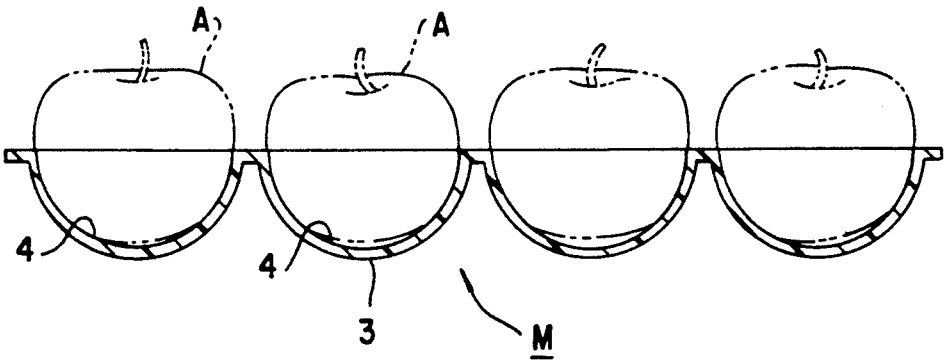
FIG. 4 is a longitudinal sectional view, showing a packaging material having a shaped resin moldate, according to a yet still another embodiment of the invention.

The packaging material M shown in FIG. 4 comprises a shaped resin moldate or a molded structural body 3. It does not have the same flexibility as films but has an appropriate degree of rigidity. Needless to mention, the molded structural body 3 comprises an electret material. In its front surface region and its back surface region, it has polarized positive charges, and polarized negative charges respectively. The shaped resin moldate or resin molded body 3 is so formed as to have a number of cup-shaped recesses 4 each for therein receiving a product to be packaged A (i.e., apples, citrus fruits). In the present embodiment of the invention, the electret material is so made as to cover not a whole but only a part of the periphery of the product A.

Figure 5:
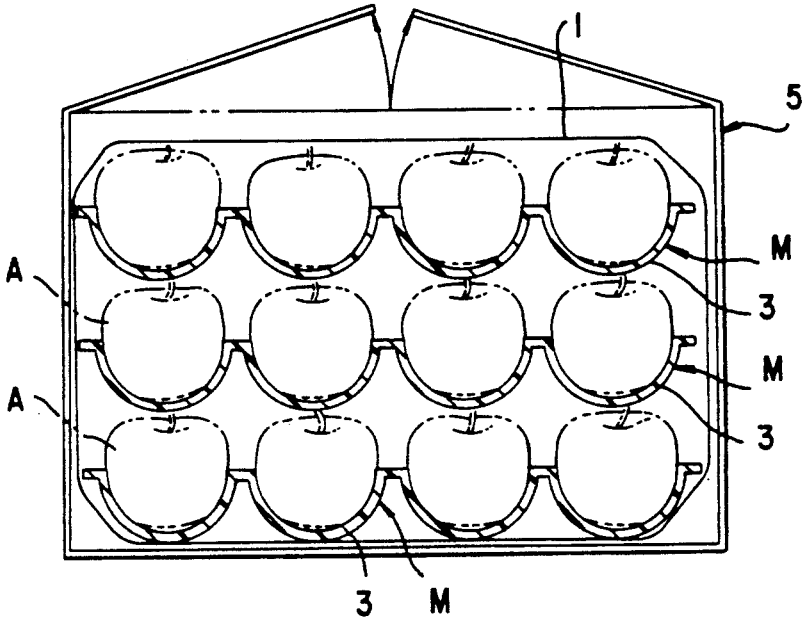
FIG. 5 shows a view, taken for illustration of the packaging method according to the invention, which is carried out with use of the packaging material according to the invention.

A plurality of shaped resin moldates 3 in which products such as apples or citrus fruits are placed in the recesses 4 may be received in a cardboard box 5 and therein stacked one on top of the other as shown in FIG. 5. If necessary, further, the whole stacked assembly of molded structural bodies 3 can be covered with a resin film 1 comprising an electret material or can have the resin film 1 placed between the adjacent stacked molded structural bodies or the shaped resin moldates 3.

The structure of the molded structural body 3 having a rigidity is not limited to the above described cup-shape one. The molded structural body 3 may comprise any of a number of optional shapes in accordance with the particular shape of the product or object to be packaged (i.e., a box shape, a dish shape and a bottle shape).

In packaging an object with a packaging material according to the invention as above, it is not always necessary to cover a whole of the object. In lieu thereof, the packaging may well be made so as to cover only a part of the object, depending on the object to be packaged. When an object is covered with the packaging material, an electrical stimulation produced in the electric field generated by the electret material acts to suppress lowering of the freshness of the covered object and/or to inhibit the growth of microorganisms such as mold on or in the object. In covering an object with the packaging material as above, the packaging material may be applied with either of its two surfaces bearing electric charges of respective polarities disposed to face the object. According to results of tests conducted by the inventors of the present invention, however, it was ascertained that negative charges exhibit a higher effect of maintaining or preserving the freshness of the packaged object.

Also, this effect of maintenance or preservation of freshness is higher as the electric field generated by the electret material is more intense. This tendency appear particularly conspicuously where the object to be packaged is a plant.

Moreover, if the air tending to remain present between the surface of a packaged object and the packaging material is removed, the effect of preservation can be enhanced in that it then is possible to inhibit or suppress the propagation of reproductive cells of germs and molds. This effect can be increasingly enhanced by raising the degree of vacuum attained.

The above described packaging material according to the present invention can be utilized not only in the cases of packaging for preservation of fresh natural foodstuffs such as fresh vegetables and fruits, but also broadly in all such other cases where it is desired to preserve an object for a long period of time without permitting an original state of the object to change. Some examples include packaging for preservation of fresh products such as decorative cut flowers and meat, and sampled animal and plant specimens.

EXAMPLE 1

Using an electret material comprising a 10 μm-thick polypropylene film (additive: 800 ppm of hindered phenol) having a surface charge density on the front surface and a surface charge density on the rear surface of $3\times10^{-9}$ coulomb/cm$^2$ of positive polarity and $2.7\times10^{-9}$ coulomb/cm$^2$ of negative polarity respectively, a carbonic acid gas permeability of 45,000 cc/m$^2$.24 hr.atm, an oxygen permeability of 12,500 cc/m$^2$.24 hr.atm, and a moisture permeability of 35 g/m$^2$.24 hr, potatoes were packaged.

Packaging was made in two different ways. In one method, the film surface carrying the positive polarity was disposed to face the potato, and in the other method the film surface carrying the negative polarity was disposed to face the potato. A comparative evaluation of the effect of preservation was made between the two different ways of packaging. Five potatoes were packaged according to each of the two ways of packaging.

By way of comparison, further, 5 potatoes were packaged in the same manner as above with a same polypropylene film as above but not made into an electret material (the surface charge density was below the determinable limit and could not be measured). An evaluation of the effect of freshness preservation was conducted on those potatoes as well.

The packaged test samples were left still in an atmosphere having a room temperature of 25° to 35° C. with a humidity of 65 to 85% and visual inspections were carried out. After a lapse of 1-month time after the initiation of the test, it was found that a white mold was propagating on the comparative test samples (packaged with the polypropylene film not made into an electret material).

In contrast to the above, on or in the test samples packaged with the electret material in each of the above described two ways of packaging, no growth of mold was observed even after the lapse of a 2-month test period, nor did the samples undergo a withering. A remarkable effect of the freshness preservation was ascertained.

EXAMPLE 2

Using the same electret material as in the above Example 1, a chrysanthemum was packaged in a manner such that while the flower portion alone was covered with the electret material, which was disposed with its negative polarity surface facing the flower, the stem was kept immersed in water for preservation.

Also, by way of a control, the same packaging as above was made using the same polypropylene film as above but not made into an electret material (the surface charge density was below the determinable limit and could not be measured).

One week after the initiation of the test, the condition of each of the two above prepared test samples was visually inspected. The flower portion of the test sample which was packaged with the electret material was found to have undergone no loss or dulling of, or change in color nor a withering; the original freshness of the flower was effectively maintained. However, the flower portion of the control sample (covered with the polypropylene film which was not made into an electret material) was found to have grown yellowish, loosing the original color, and to have been withered.

EXAMPLE 3

Using an electret material comprising a 12 μm-thick polypropylene film having a surface charge density of electric charges imparted on the front surface and a surface charge density on the rear surface respectively of $9\times10^{-9}$ coulombs/cm$^2$ of positive polarity and of $1\times10^{-8}$ coulombs/cm$^2$ of negative polarity, a carbonic acid gas permeability of 30,000 to 40,000 cc/m$^2$.24 hr.atm, an oxygen permeability of 7,200 to 11,800 cc/m$^2$.24 hr.atm, and a moisture permeability of 27 to 29 g/m$^2$.24 hr, a 2-ply laminate was prepared by laminating two of the above films together with the directions of their electric fields arranged to be the same.

Using the above prepared polypropylene film laminate as packaging material, tangerines (citrus unshiu) were packaged in a completely sealed manner with the negative polarity surface of the laminate closely contacted with the surface of the tangerines. The packaged test samples were left still in a room of a temperature of 20° C.±2° C. and a humidity of 65%±2%.

Test samples were prepared in the number of 20, and by visually inspecting the decaying conditions of the test samples with the lapse of days, a preservation efficiency rate K was determined according to the following equation.

$$\text{preservation efficiency rate } K\ (\%) = \frac{N-n}{N} \times 100$$

N: the number of test samples; and n: the number of test samples which underwent damage such as decay, mold propagation and/or drying As a result of the above test, the preservation efficiency rates found were 100% after the lapse of a one-month test period and 70% after the lapse of a two-month test period. Also, it was found that most of the test samples did not impair their original appearance and that a highly remarkable effect of preservation was attained.

COMPARATIVE EXAMPLE 1

Using polypropylene films having a thickness, a permeability of carbonic acid gas, an oxygen permeability and a moisture permeability which were all same as those of the film used in the above Example 3, the films however not being made into electret material, a 2-ply laminate was prepared.

Then, using the above prepared laminate as packaging material, packaging of tangerines was made, and under the same conditions as in Example 3, with respect to the number of samples and the manner in which the test samples were left still, a similar test as in Example 3 was conducted.

As a result of the test, it was found that the effect of preservation attained was very poor such that the preservation efficiency rates were 60% after the lapse of a one-month test period and 5% after the lapse of a two-month time after the initiation of the test.

COMPARATIVE EXAMPLE 2

Using a 2-ply laminate of a commercially obtained polyvinylidine chloride film of 10 μm in thickness, having a permeability of carbonic acid gas of 72 to 105 cc/m$^2$.24 hr. atm, an oxygen permeability of 32 to 40 cc/m$^2$.24 hr.atm and a moisture permeability of 2 to 2.5 g/m$^2$.24 hr, a similar completely sealed packaging of tangerines as in Example 3 was made with the above laminate as the packaging material. The same preservation test as in Example 3 was conducted under the same conditions as in Example 3 with respect to the number of test samples and the manner in which the test samples were left still.

As a result of the test, it was found that the preservation efficiency rates were 30% after the lapse of a one-month time and 0% after the lapse of a two-month time after the initiation of the test, when all test samples were rotted and had completely lost their original configurations.

COMPARATIVE EXAMPLE 3

Using a 2-ply laminate prepared from a polyethylene film which was not made into an electret material and which had the same thickness as the film used in Example 3, a carbonic acid gas permeability of 28,000 to 36,000 cc/cm$^2$.24 hr.atm, an oxygen permeability of 9,000 to 10,000 cc/cm$^2$.24 hr.atm and a moisture permeability of 29 to 31 g/m$^2$.24 hr, a similar completely sealed packaging of tangerines as in Example 3 was made with the present laminate packaging material. Again, the same preservation test as in Example 3 was conducted under the same conditions as in Example 3 with respect to the number of test samples and the manner in which the test samples were left still.

As a result of the test, it was found that the preservation efficiency rates were 10% after the lapse of a one-month test period and 0% after the lapse of a two-month test period, when all test samples were decayed and had undergone growth of mold.

COMPARATIVE EXAMPLE 4

Under the same conditions as in Example 3 with respect to the number of test samples and the manner in which the test samples were left still, another similar preservation test as in Example 3 was operated with similar tangerines as in Example 3, except that the tangerines were not packaged with any resin film but were left in an uncovered or a naked state.

As a result of this test, it was found that the preservation efficiency rates were 10% after the lapse of a one-month test period and 0% after the lapse of a two-month test period, when all test samples were dried and had undergone contraction with the freshness completely lost.

EXAMPLE 4

Using as packaging material a 24 μm-thick polypropylene film which had a surface charge density of electric charges imparted on the front surface and a surface charge density on the rear surface of $9\times10^{-9}$ coulomb/cm$^2$ of positive charges and $9\times10^{-9}$ coulomb/cm$^2$ of negative charges respectively, a carbonic acid gas permeability of 13,000 to 20,000 cc/m$^2$.24 hr.atm, an oxygen permeability of 3,400 to 6,000 cc/m$^2$.24 hr.atm, and a moisture permeability of 14 to 16 g/m$^2$.24 hr, a number of completely sealed packaged test samples of sampled clover specimens was prepared by placing the clover between two films which were put one above the other in a manner such that the negative polarity surfaces of respective films faced each other. The laminate of the piled films was melt-cut by a heat cutter at peripheral portion 5 cm distant from the location of the clover specimen so that venting could not take place into and out of the packaged samples.

Then, the test samples were left still in a room having a room temperature of 20° C.±2° C. and a humidity of 65%±2% to carry out a test to find dulling of and/or change in the color of the clover.

As a result of the test, it was found after the lapse of a two-month test period that although the leaves of clover more or less underwent a contraction, their color did not undergo a dulling or change and they remained to be in their original dark green color. No sprout or growth of a mold was observed, either.

COMPARATIVE EXAMPLE 5

Using as packaging material a polypropylene film which had a same thickness as the film used in the above Example 4 and was also identical to the film in Example 4 with respect to each of the carbonic acid gas permeability, the oxygen permeability and the moisture permeability but which was not made into an electret material a number of completely sealed packaged test samples were prepared by interposing sampled clover specimens between two of the above film in the same manners as in Example 4. The laminate of films was melt-cut by a heat cutter at its peripheral portion 5 cm distant from the location of the clover so that no venting could take place into and out of the test samples. Under the same conditions as in Example 4 with respect to the number of test samples and the manner in which the test samples were left still, a similar preservation test as in Example 4 was carried out.

As a result of the test, it was found that after the lapse of a three-week test period, most of the test samples underwent dulling of the color of the leaves of the clover and that by the end of a one-month test period, all clover specimens underwent a color change into brown. Also, after the lapse of one-month test period, the growth of a mold was observed in connection with 40% of the test samples.

COMPARATIVE EXAMPLE 6

Using as packaging material a commercially obtained polyvinylidine chloride film of 10 μm in thickness, having a carbonic acid gas permeability of 72 to 105 cc/m$^2$.24 hr.atm, an oxygen permeability of 32 to 40 cc/m$^2$.24 hr.atm and a moisture permeability of 2 to 2.5 g/m$^2$.24 hr, a number of completely sealed packaged test samples of sampled clover specimens was prepared by interposing the clover specimens between two of the above film in same manner as in Example 4 Again, the laminate of films was melt-cut by a heat-cutter at its peripheral portion 5 cm distant from the location of the clover specimens so that no venting could take place into and out of the test samples. Then, under the same conditions as in Example 4 with respect to all of the number of test samples and the condition in which the test samples were left still, a similar preservation test as in Example 4 was carried out.

As a result of the test, it was found that after the lapse of a two-week test period, most of the test samples underwent dulling of the color of the leaves of the clover and that after the lapse of a three-week test period, all clover specimens underwent a color change into brown, same as in the above Comparative Example 5. Also, after the lapse of a one-month test period, it was confirmed that the growth of mold had taken place in connection with all or 100% of the test samples.

COMPARATIVE EXAMPLE 7

Using as packaging material a polyethylene film which had the same thickness as the film used in Example 4, a carbonic acid gas permeability of 12,000 to 19,000 cc/m$^2$.24 hr.atm, and oxygen permeability of 4,000 to 5,000 cc/m$^2$.24 hr.atm, and a moisture permeability of 15 to 17 g/m$^2$.24 hr but which was not made into an electret material, a number of completely sealed packaged test samples of sampled clover specimens was prepared by interposing clover specimens between two of the above film in same manner as in Example 4. The laminate of the films again was melt-cut by a heat-cutter at its peripheral portion 5 cm distant from the location of the clover specimens so that no venting could take place into and out of the test samples. Then, a similar preservation test as in Example 4 was operated under the same conditions as in Example 4 with respect to all of the number of test samples and the condition in which the test samples were left still.

As a result of the test, it was found that after the lapse of a two-week test period, most of the test samples underwent a dulling of the color of the leaves of the clover and that after the lapse of a three-week test period, 50% of the clover specimens underwent a color change into yellow, while 35% of the specimens changed the color into yellowish brown. Also, 15% of clover specimens changed the color into brown, and the rate of specimens which remained green was only 5%. After the lapse of a one-month test period, mold generation was observed in connection with 25% of the test samples.

Further, similar comparative preservation tests as above were carried out also using products such as cucumbers, cabbages and spinaches for the class of fresh vegetables, apples for the class of fresh fruits, and the flowers, stems and leaves of marguerites and chrysanthemums for the class of flowering plants and cut flowers sold at flower stands or florists.

The results of the above tests showed that although there is variation in the number of days during which a decay takes place depending on a difference in the kind of objects to be packaged, in each instance of the tests the packaging with use of the packaging material according to the present invention brings about an exceeding result of preservation in comparison with the packaging with other packaging materials.

As described above, the packaging material according to the present invention can bring about the effect of suppressing or lowering of the freshness, and of inhibiting propagation of reproductive cells of germs and molds through the activity of an electric stimulation from an electric field generated by the electret material. This packaging material can preserve the objects or products packaged therewith in their original state or condition for a long period of time. Also, the packaging material of the invention can suppress dulling of, or other change in the color of packaged products and can maintain their attractive appearances intact for a long period of time.

We claim:

1. A packaging material for preserving freshness of degradable foodstuffs, which comprises:

an electret sheet of a film of a resin, having mutually different polarized electric charges on front and rear surfaces and a surface charge density of at least $1\times10^{-11}$ coulomb/cm$^2$ on each surface, a permeability of carbonic acid gas of 500 to 350,000 cc/m$^2$ 24 hr atom and an oxygen permeability of 100 to 35,000 cc/m$^2$ 24 hr atom.

2. A packaging material as set forth in claim 1 wherein said resin is polyolefin resin.

3. A method for packaging so as to preserve freshness of degradable foodstuffs, comprising the steps of:

forming a packaging material which incorporates an electret sheet of a film of a resin, having mutually different polarized electric charges on front and rear surfaces and a surface charge density of at least $1\times10^{-11}$ coulomb/cm$^2$ on each surface, a permeability of carbonic acid gas of 500 to 350,000 cc/m$^2$ 24 hr atom and an oxygen permeability of 100 to 35,000 cc/m$^2$ 24 hr atom; and packaging the foodstuffs in the formed packaging material.

* * * * *

UNITED STATES PATENT AND TRADEMARK OFFICE

CERTIFICATE OF CORRECTION

PATENT NO. : 5,266,369

DATED : November 30, 1994

INVENTOR(S) : Katsutoshi ANDO et al

It is certified that error appears in the above-identified patent and that said Letters Patent is hereby corrected as shown below:

On the title page, Item [63], second line, change "PCT/TP88/0955" to -- PCT/JP88/0955 --.

Signed and Sealed this

Thirtieth Day of August, 1994

*Attest:*

Bruce Lehman

BRUCE LEHMAN

*Attesting Officer*

*Commissioner of Patents and Trademarks*